US009068545B2

(12) United States Patent
Gorenflo et al.

(10) Patent No.: US 9,068,545 B2
(45) Date of Patent: Jun. 30, 2015

(54) METHOD AND DEVICE FOR PROVIDING ELECTRIC ENERGY FOR AN ENGINE CONTROL UNIT

(75) Inventors: Ernst Gorenflo, Bad Rappenau (DE); Heinrich Leufen, Schaikheim (DE); Eberhard Schieber, Backnang (DE); Roland Schierling, Affalterbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 1103 days.

(21) Appl. No.: 12/969,648

(22) Filed: Dec. 16, 2010

(65) Prior Publication Data

US 2011/0146611 A1 Jun. 23, 2011

(30) Foreign Application Priority Data

Dec. 18, 2009 (DE) ..... 10 2009 058 971

(51) Int. Cl.

| | |
|---|---|
| ***F02N 1/00*** | (2006.01) |
| ***F02N 3/02*** | (2006.01) |
| ***F02N 5/02*** | (2006.01) |
| ***F02P 1/08*** | (2006.01) |
| *F02D 41/22* | (2006.01) |
| *F02N 11/08* | (2006.01) |

(52) U.S. Cl.

CPC ..... *F02N 3/02* (2013.01); *F02D 2041/228* (2013.01); *F02D 2400/06* (2013.01); *F02D 2400/14* (2013.01); *F02N 5/02* (2013.01); *F02N 11/0862* (2013.01); *F02N 2011/0885* (2013.01); *F02P 1/086* (2013.01)

(58) Field of Classification Search

CPC ..... F02B 63/02; F02N 3/02

USPC ..... 123/179.24, 179.25, 179.28, 179.26, 123/185.2, 185.3, 184.1; 185/39, 40 B, 41 A, 185/41 C, 41 R; 30/123.4, 144, 166.3

See application file for complete search history.

(56) References Cited

U.S. PATENT DOCUMENTS

| | | | | |
|---|---|---|---|---|
| 4,862,010 A | | 8/1989 | Yamamoto | |
| 4,917,060 A | * | 4/1990 | Harada et al. | 123/179.3 |
| 5,083,534 A | | 1/1992 | Morishima et al. | |

(Continued)

FOREIGN PATENT DOCUMENTS

| | | |
|---|---|---|
| CN | 1708639 A | 12/2005 |
| JP | 63-297767 | 12/1988 |

(Continued)

*Primary Examiner* — Mahmoud Gimie
*Assistant Examiner* — Sizo Vilakazi
(74) *Attorney, Agent, or Firm* — Gudrun E. Huckett

(57) ABSTRACT

In a method for providing in a hand-held power tool electric energy for an engine control unit before start of an internal combustion engine of the power tool that is to be started by a rope starter, a voltage source is provided that generates electric energy electro-dynamically or photovoltaically before starting the internal combustion engine. The thus generated electric energy is stored in a rechargeable energy storage device arranged within the power tool. The electric energy stored in the energy storage device is supplied to the engine control unit upon first rope starter pull for start of the internal combustion engine. The device for performing the method has an electro-dynamic or photovoltaic voltage source and an energy storage device electrically conductingly connected to the voltage source, wherein the energy storage device has an output that is electrically conductingly connected to the engine control unit.

17 Claims, 5 Drawing Sheets

(56) References Cited

U.S. PATENT DOCUMENTS

| | | | | |
|---|---|---|---|---|
| 5,115,773 | A * | 5/1992 | Morishima | 123/179.24 |
| 5,163,392 | A * | 11/1992 | Morishima et al. | 123/179.25 |
| 5,537,966 | A * | 7/1996 | Ohnishi | 123/185.14 |
| 5,560,345 | A | 10/1996 | Geyer et al. | |
| 5,816,221 | A * | 10/1998 | Krueger | 123/491 |
| 6,758,181 | B2 * | 7/2004 | Iida et al. | 123/179.24 |
| 6,830,023 | B2 | 12/2004 | Tharman et al. | |
| 7,270,100 | B2 * | 9/2007 | Ruppel et al. | 123/179.24 |
| 2004/0025839 | A1 * | 2/2004 | Kashibata et al. | 123/406.47 |
| 2006/0087280 | A1 * | 4/2006 | Miyashita et al. | 320/104 |
| 2007/0006839 | A1 * | 1/2007 | Ruppel et al. | 123/179.24 |
| 2009/0020094 | A1 * | 1/2009 | Ono | 123/179.28 |

FOREIGN PATENT DOCUMENTS

| | | | |
|---|---|---|---|
| JP | H01-158568 | U | 11/1989 |
| JP | H05-2022833 | A | 8/1993 |
| JP | 2004-169553 | A | 6/2004 |
| JP | 2008-223531 | A | 9/2008 |

* cited by examiner

METHOD AND DEVICE FOR PROVIDING ELECTRIC ENERGY FOR AN ENGINE CONTROL UNIT

BACKGROUND OF THE INVENTION

The invention concerns a method for providing electric energy for an engine control unit before start of an internal combustion engine of a hand-held power tool which engine is to be started by means of a rope starter, wherein for the electric energy of the engine control unit a voltage source is provided.

The invention also concerns a device for providing an engine control unit with electric energy before start of an internal combustion engine that is to be started by means of a rope starter, the device comprising a voltage source for the electric energy of the engine control unit.

Hand-guided power tools like motor chain saws, trimmers, cut-off machines, pole pruners, and suction/blower devices are often equipped with an internal combustion engine that is started generally by means of a rope starter. A generator arranged in the power tool is driven by the crankshaft so that in operation of the internal combustion engine a sufficient voltage supply is available for the ignition circuit and engine control unit. In the starting phase, i.e., from performing the first rope stroke or pull to reaching a predetermined engine speed, the voltage delivered by the generator is not enough to ensure an immediate function of the engine control unit or the microprocessor-controlled ignition. For eliminating this disadvantage, it has already been suggested to employ a battery that provides the power required during starting for operating the engine control unit or the electronic ignition during the starting phase of the internal combustion engine. However, such a battery must be exchanged based on the load frequency or after a certain time, i.e., the battery must be serviced and regular charging is necessary to ensure a good starting readiness of the internal combustion engine.

It is the object of the present invention to provide a method for supplying electric energy for an engine control unit of the aforementioned kind with which in an easy manner the electric energy can be generated and stored. Moreover, the object resides in providing a device for performing the method for generating and storing the electric energy.

SUMMARY OF THE INVENTION

This object is solved for the method in that before start of the internal combustion engine the voltage source generates electric energy electro-dynamically or photovoltaically, in that the energy is supplied to a rechargeable energy storage device arranged within the power tool, and in that, upon a first rope starter pull for starting the internal combustion engine, stored energy is supplied to the engine control unit.

This object is further solved for the device in that an electro-dynamic or photovoltaic voltage source is provided and in that an energy storage device is provided that is connected to the voltage source, wherein the energy storage device is electrically conductingly connected with its output to the engine control unit.

The invention enables to generate independently electric energy in the power tool before start of the internal combustion engine and to store the electric energy until starting the internal combustion engine. The components required for this are maintenance-free and require only little space.

The energy can be used in one embodiment of the invention also for a first and advantageously also the following ignitions for which purpose the energy stored in the energy storage device is supplied to an ignition circuit.

The voltage generation on account of the electric-dynamic principle can be realized in different ways, for example, through a dynamo that is to be operated mechanically by hand. For this purpose a translatory movement (e.g., a slide), an oscillatory movement (e.g., a push button) or a rotary movement (e.g., a crank or a rotary knob) can be used as a driving mechanism. Alternatively, it is also possible to actuate the rope starter several times, expediently while the fuel to supply to the internal combustion engine is blocked, and to supply the energy that is generated in this way in the generator driven by the crankshaft to the energy storage device. It is also possible to provide one or several permanent magnets as a voltage source and to assign coils to them so that—even without rotation of the crankshaft—upon actuation of the starter device, e.g., of the rope starter, an electric voltage is induced in the coils.

Another embodiment of the device a solar cell can be provided as a voltage source. In the solar cell the voltage that is generated by photovoltaic charges the energy storage device from which then during starting of the internal combustion engine the energy is retrievable. As an alternative to the solar cell, the already mentioned hand-operated dynamo can be used as a voltage source or the generator integrated in the power tool and driven by the crankshaft.

Another possibility for generating electric energy in such a power tool resides in that a piezo element is loaded with a force. Expediently, the generation of electric energy is combined with a device for supplying fuel and/or for supplying an initial operating pressure of the fuel. Thus, the activation of the piezo element can be combined with the activation of a purger that is working as a fuel pump. At the same time with the generation of electric energy fuel is conveyed or fuel pressure is provided so that with a first rotation of the crankshaft fuel is already available for forming the fuel/air mixture. Expediently, in case of a carburetor the activation of the purger is coupled with the activation of the dynamo (dynamo purger) so that mechanically energy is generated and fuel is conveyed or a fuel pressure is built up. In case of devices with electric systems for fuel supply (fuel pump) the energy available in the energy storage device can be used accordingly for conveying fuel or for providing an initial fuel pressure.

The energy storage device encompasses, for example, a capacitor, in particular an electrolytic capacitor; as an alternative, however, also a battery can be provided. At least the engine control unit is connected to the output side of the energy storage device; in a preferential embodiment, the ignition circuit is additionally connected to the energy storage device. In order for the operator to recognize whether, for the purpose of starting the internal combustion engine, the required electric energy for the engine control unit and optionally the ignition circuit is present in the energy storage device, a signal device is provided; it is preferably a light signal indicator that indicates a sufficient charge state of the energy storage device.

In one embodiment of the invention it is provided that a mechanical fuel pump is provided for supplying the fuel pressure before starting the engine.

BRIEF DESCRIPTION OF THE DRAWINGS

Embodiments of the invention are explained in the following with the aid of the drawing in more detail.

DESCRIPTION OF PREFERRED EMBODIMENTS

Figure 1:
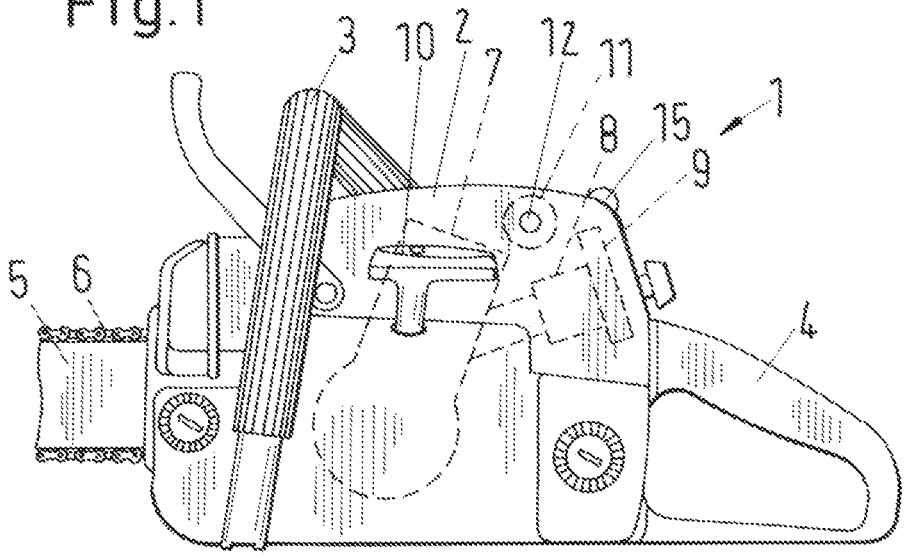
FIG. 1 shows a hand-guided power tool in the form of a motor chain saw with a hand-operated dynamo.

In FIG. 1 a motor chain saw 1 is illustrated that has an engine housing 2 with a front handle 3 and a rear handle 4 arranged thereat. At the front end of the engine housing 2 a guide bar 5 with a saw chain circulating on the guide bar 5 is projecting forwardly. In the engine housing 2 there is an internal combustion engine 7 with a carburetor 8 and air filter 9. The internal combustion engine 7 can be started by means of a rope starter that is pulled by means of a starter handle 10. In the engine housing 2 a dynamo 11 is arranged that is operable, depending on its construction, by means of a push button or rotary knob 12.

In the engine housing 2 there is an engine control unit encompassing a microprocessor and an ignition circuit; the electric energy is generated during operation of the internal combustion engine 7 by a generator driven by the crankshaft. In order to provide immediately sufficient electric energy to the engine control unit and optionally also to the ignition circuit when starting the internal combustion engine, a voltage source is provided, for example, in the form of the aforementioned dynamo 11 that generates electric energy by repeated activation of the push button 12. This energy is supplied to an energy storage device, not shown in FIG. 1, that, when starting the internal combustion engine 7 by means of the rope starter, supplies the electric energy that is necessary for the starting procedure to the engine control unit, optionally the ignition circuit, and expediently an electric pump for conveying fuel.

A light signal indicator 15, for example, in the form of a LED, serves for indicating that sufficient electric energy is present in the energy storage device for the activation of the engine control unit and the ignition circuit. Alternatively, a display or another instrument can be also provided for displaying or indicating the stored energy.

Figure 2:
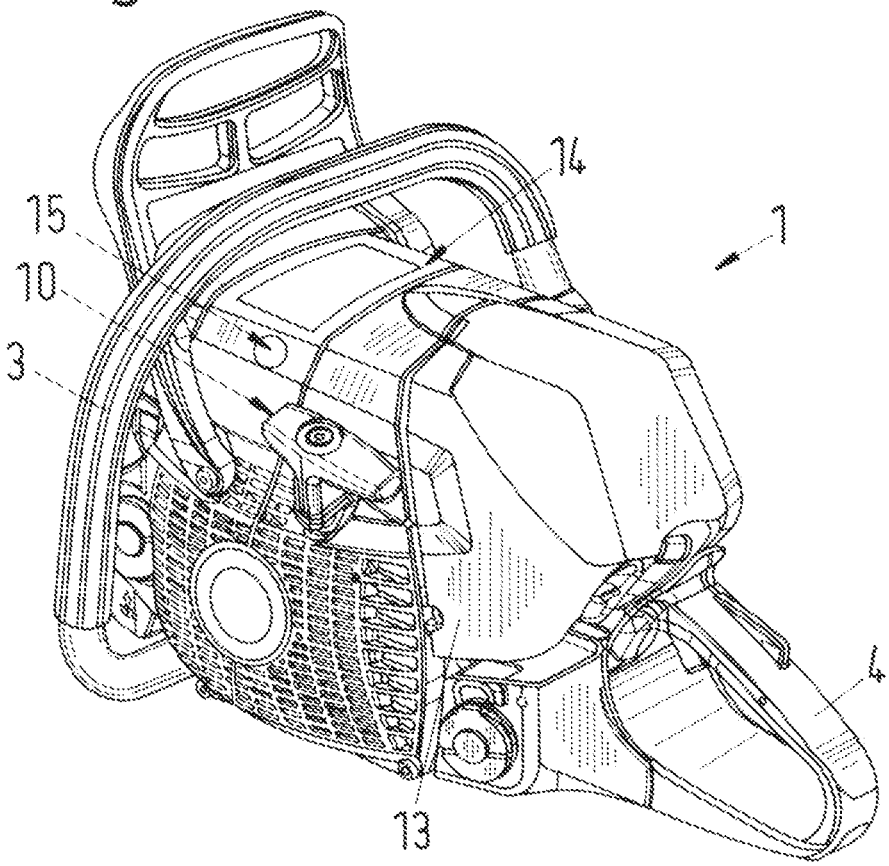
FIG. 2 shows an engine housing of a motor chain saw with a solar cell.

FIG. 2 shows an engine housing 13 of a motor chain saw 1 with front handle 3 and rear handle 4 as well as starter handle 10. For generating electric energy that is supplied to the energy storage device, a solar cell 14 is provided on the engine housing 13 in this embodiment. Such solar cells are known in general and consist of a semiconductor material with a p-n junction located near the surface that generates an electrical field, so that, when energy is supplied in the form of sunlight, charge carriers are generated that are guided by the p-n junction in different directions and generate a DC voltage. The solar cell 14 serves as a voltage source for supplying the energy storage device with energy which energy storage device supplies electric energy to the engine control unit and optionally to the ignition circuit when needed, i.e., upon starting the internal combustion engine. In order to indicate the readiness of the energy storage device for activation of the engine control unit and the ignition circuit, a light signal device 15 is provided. An acoustic signal device can be expedient.

Figure 3:
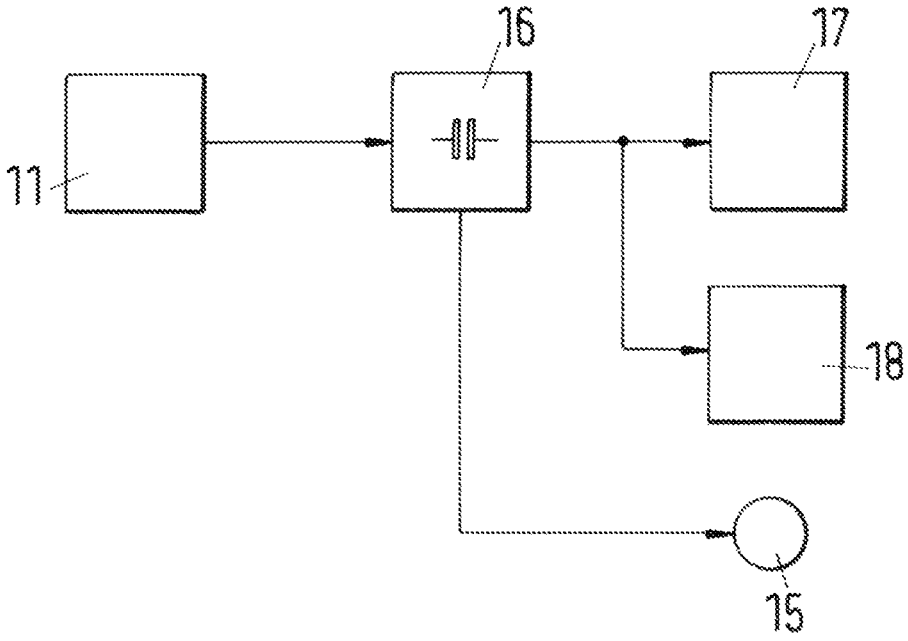
FIG. 3 is a block diagram.

In FIG. 3 a block diagram is shown in which a hand-operated dynamo 10 is provided as a voltage source. Alternatively, the generator driven by the internal combustion engine can serve as a voltage source, as has been described in connection with FIG. 1. As another alternative, a solar cell can generate the voltage, as explained in connection with FIG. 2. The generated electric energy is supplied to a so-called volatile energy storage device 16 that encompasses, for example, a capacitor and therefore supplies short term the stored energy essentially completely. As soon as sufficient electric energy is stored for the activation of the engine control unit and the ignition circuit, this is signaled by the light signal device 15. Upon the first rope stroke or pull for starting the internal combustion engine, the charge that is stored in the energy storage device 16 is supplied to an engine control unit 17 and an ignition circuit 18. This charge is sufficient for the starting procedure and advantageously is also sufficient to reach the point when the internal combustion engine is running properly. Then the electric power supply occurs through the generator powered by the internal combustion engine. In addition, the engine control unit 17 may also be connected in power tools with electric systems for the fuel supply to the fuel pump and to the fuel valve so that the electric energy is also used for the initial fuel conveyance or fuel supply. Instead of the volatile energy storage device 16 a battery may be provided also.

Figure 4:
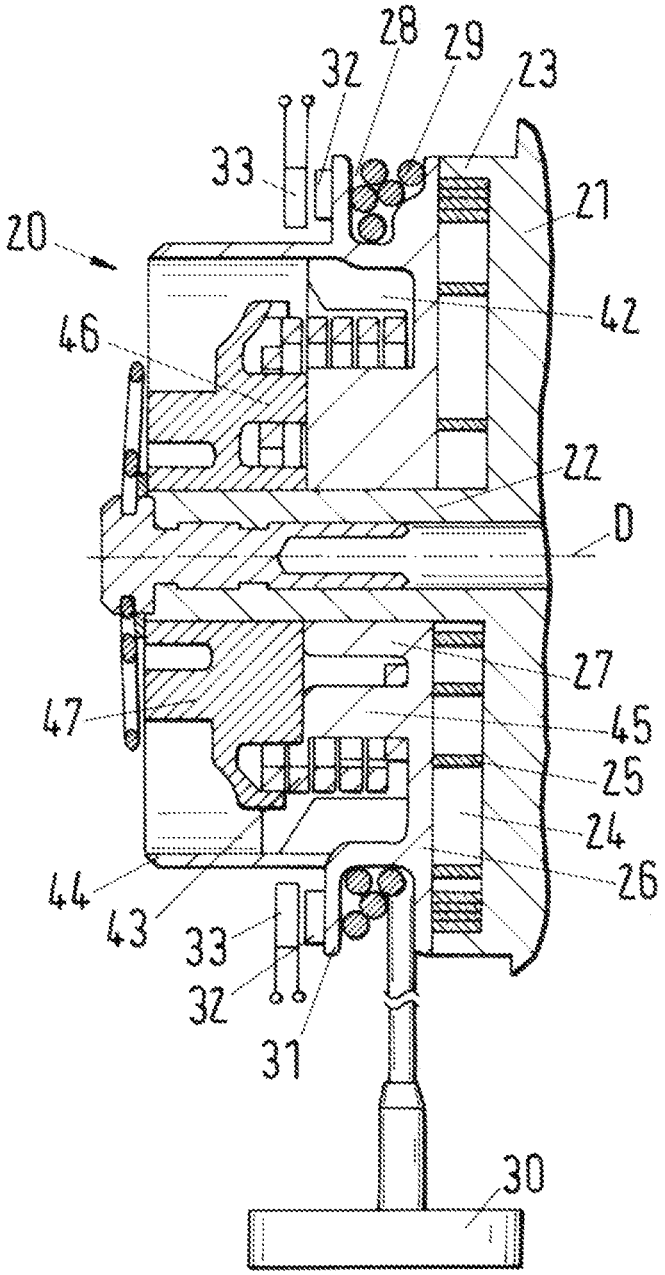
FIG. 4 is a longitudinal section of a starter device including a device for electro-dynamic energy generation.

In FIG. 4 a starter device 20 is shown that is arranged in a housing 21 of a hand-guided power tool, for example, of a motor chain saw, a cut-off machine, a trimmer, or the like, and serves for starting the internal combustion engine of the hand-guided power tool. The starter device 20 has a bearing shaft 22 that is supported on the housing 21 and that may be embodied in a one-piece configuration together with the housing 21. The housing 21 has a rim 23 that delimits a receptacle 24. In the receptacle 24 a restoring spring 25 is arranged that is embodied as a coil spring. The receptacle 24 is closed by a rope wheel 26.

The rope wheel 26 is supported on a hub 27 on the bearing shaft 22 so as to rotate about an axis of rotation D. On its outer periphery the rope wheel 26 has a receiving groove 28 in which a starter rope 29 is rolled up. To the starter rope 29 a starter handle 30 is secured that projects from the housing 21 of the power tool and can be gripped by an operator. The rope on the starter handle 30 causes unwinding of the starter rope 29 and thereby a rotary driving action of the rope wheel 26 about the axis of rotation D.

Radially within the receiving groove 28 the rope wheel 26 has a depression 42 in which a coil spring 43 is arranged. A cylindrical edge 44 extends away from the rope wheel 26, and the depression 42 and the edge 44 form a receiving space in which the coil spring 43 is arranged. Moreover, a catch 47 is arranged in the receiving space and is supported with a hub on the bearing shaft 22 so as to rotate about the axis of rotation D. The coil spring 43 is secured with a first end to a holder 45 of the rope wheel 26 and with the second end to a holder 46 of the catch 47. The coil spring 43 thereby transfers a rotation of the rope wheel 26 onto the catch 47. On its inner periphery the coil spring 43 is guided by guide webs on the rope wheel 26 and guide webs on the catch 47. The catch 47 is connectable by means of a locking mechanism, not shown in the drawing, with the crankshaft of the internal combustion engine. On a flange 31 that is delimiting the receiving groove 28 there are several permanent magnets 32. At a minimal axial distance to the permanent magnets 32 stationary coils 33 are arranged in the housing 21.

When operating the rope wheel 26 by means of the starter handle 30 or starter rope 29 the rope wheel 26 is rotated relative to the catch 47. By means of the crankshaft that is connected to a piston of the internal combustion engine, the catch 47 is initially secured while the rope wheel 26 is rotating. The coil spring 43 is thereby tensioned. This causes the diameter of the windings of the coil spring 43 to be reduced and at the same time the coil spring is extended lengthwise. After completion of the tensioning action of the coil spring 43, the further rotation of the rope wheel 26 and the force of the tensioned coil spring 43 will act on the crankshaft so that a sufficient force is provided for starting the internal combustion engine. Upon rotation of the rope wheel 26 an electric voltage is induced in the coils 33 by the movement of the permanent magnets 32; this voltage is used for charging the energy storage device 16 shown in FIG. 3. The electric energy for the motor control unit and/or ignition therefore exists already before the internal combustion engine is started or running.

As an alternative to the dynamo to be operated by hand as described in connection with FIG. 1, it may also be provided, as a variant to FIG. 4, that from about two to four starting strokes or pulls of the rope starter are carried out with closed fuel supply and the generator driven by the crankshaft supplies the electric energy generated therein to the energy storage device. Only thereafter, the fuel supply is released for further starting strokes. It is furthermore possible to provide an actuatable clutch between the dynamo within the rope wheel and the crankshaft.

By means of a starting stroke of the rope starter fuel may be conveyed (purged) as described in U.S. Pat. No. 5,560,345, assigned to instant assignee, the disclosure of which is incorporated by reference. Particularly FIG. 6 is relevant in this connection.

Figure 5:
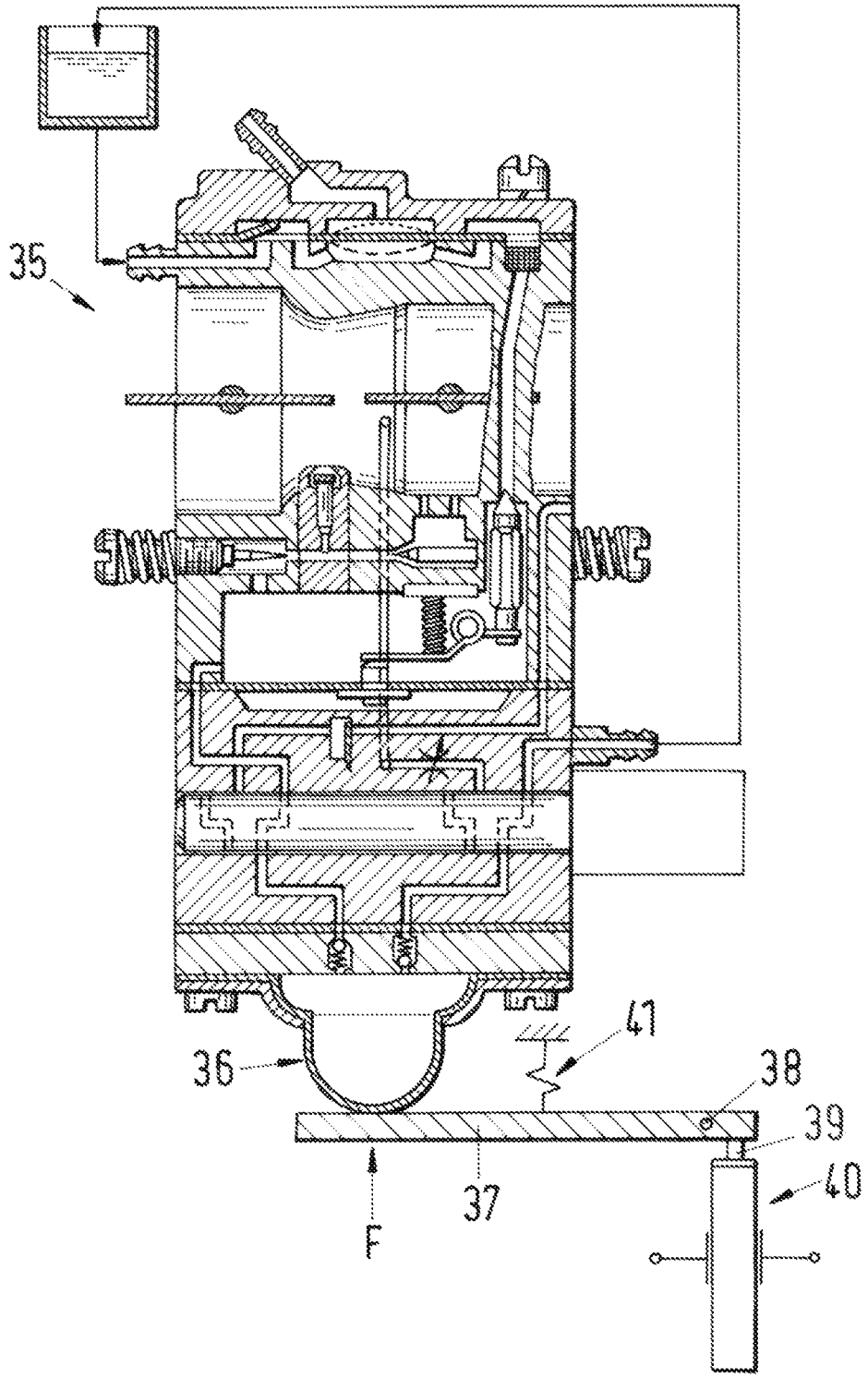
FIG. 5 is a section of a carburetor with purger and device for electro-dynamic energy generation.

In FIG. 5 a section view is shown of a carburetor 35 with a purger 36. The purger 36 is operated by pressing on a lever 37 that is supported so as to swivel in the direction of the arrow F. The end of the lever 37 that is located to the right of swivel axis 38 presses a pressure pin 39 against a piezo element 40 so that in the piezo element 40 electric voltage is generated that is supplied to energy storage device 16 shown in FIG. 3. To enable a quicker return of the lever 37 into the initial position, a restoring spring 41 can be provided. With this arrangement, fuel is mechanically conveyed before the internal combustion engine is started and, at the same time, electric energy is generated mechanically for starting the internal combustion engine.

When the energy storage device 16 is dimensioned appropriately with respect to size and a sufficient amount of electric energy is generated, for example, in case of extended solar irradiation of a solar cell, an energy supply for an electric starting procedure is also possible.

Figure 6:
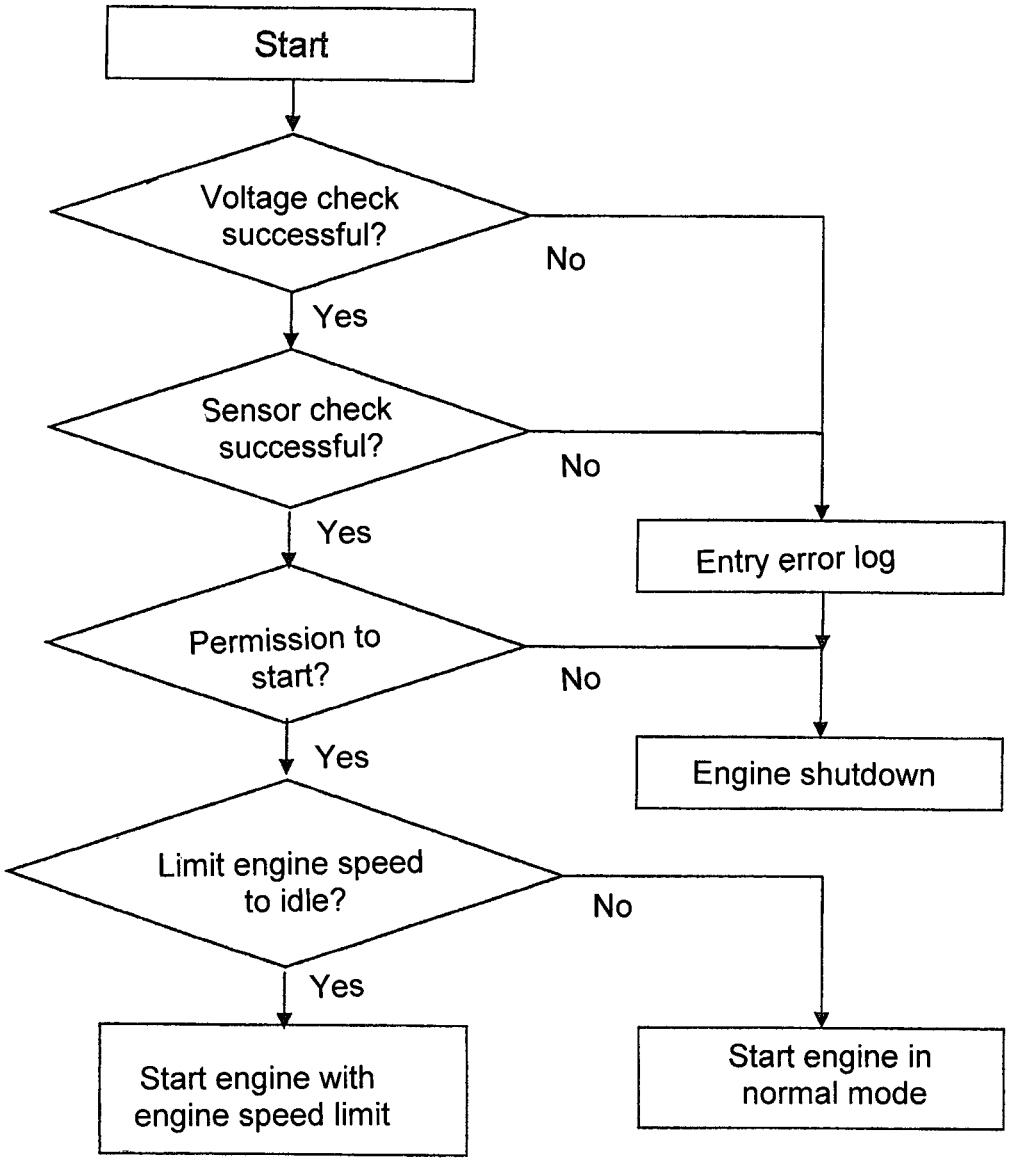
FIG. 6 is a flow chart for a check to be performed before starting an internal combustion engine.

In FIG. 6 a flowchart is shown for a check to be carried out before start of the internal combustion engine with regard to the proper function of the monitored sensors and actuators. The energy for this check is taken from the energy storage device 16 in FIG. 3. In this example the energy management is checked first before the start in order to determine whether the energy management of the internal combustion engine is functioning properly. If the result indicates a malfunction, i.e., "No", an entry is made in an error memory (error log); when the result indicates proper function, the sensor check is carried out next. In this context, all sensors are checked, for example, sensors for pressure, temperature, position of the start/stop switch and the like with regard to plausibility and, in this connection, an entry in the error memory is also recorded when the result indicates malfunction, i.e. is "No". When the check results are proper, the internal combustion engine is started, provided that in the error memory there are no prior entries that prevent a start. When the result of the query "Permission to start?" is "Yes", the internal combustion engine is started and it is queried whether the engine speed should be limited to idle. When the result is "No", the internal combustion engine is started in "normal mode", when the result is "Yes", the internal combustion engine is started with limited engine speed.

The internal voltage supplies of the control unit are also monitored and it is therefore checked implicitly whether generally enough energy exists for a start procedure.

The engine control unit monitors preferably all sensors and actuators in operation of the power tool. Errors that occur are detected by the control unit and are recorded in an error memory. With regard to the termination of running of the internal combustion engine, four situations are distinguished by the control unit:

- stop switch is operated, no entry in the error log of the error memory;
- error that has been recognized leads to shutdown, entry in the error log of the error memory;
- an error that has not been recognized leads to the internal combustion engine shutting down, no entry in the error log of the error memory:
- lack of fuel, no entry in the error log of the error memory.

According to an alternative embodiment, a restart of the internal combustion engine can be made dependent also based on weighting / classification of the errors. For example, the restart of the internal combustion engine is allowed when a comfort function has failed, for example, the heating function of the handle. It is also conceivable that a failure that does not impair operation of the internal combustion engine is indicated, for example, by means of a special ignition pattern during the starting procedure.

The specification incorporates by reference the entire disclosure of German priority document 10 2009 058 971.6 having a filing date of Dec. 18, 2009.

While specific embodiments of the invention have been shown and described in detail to illustrate the inventive principles, it will be understood that the invention may be embodied otherwise without departing from such principles.

What is claimed is:

1. A method for providing in a hand-held power tool electric energy for an engine control unit before start of an internal combustion engine of the power tool that is to be started mechanically by a rope starter, the method comprising the steps of providing a voltage source as a voltage supply for the engine control unit, wherein the voltage source provides electric energy for operating the internal combustion engine and wherein the voltage source is driven by a mechanical drive action;

an operator driving the mechanical drive action, prior to a first rope starter pull being carried out, to generate electric energy by the voltage source before start of the internal combustion engine;

storing the electric energy generated by the voltage source in a rechargeable energy storage device arranged within the power tool; and supplying the electric energy stored in the energy storage device to the engine control unit upon carrying out the first rope starter pull for starting the internal combustion engine.

2. The method according to claim 1, wherein the electric energy stored in the energy storage device is supplied to an ignition circuit for a first ignition.

3. The method according to claim 1, wherein, in the step of the operator driving the mechanical drive action to generate electric energy by the voltage source, the voltage source is a manually operated dynamo operated by the operator.

4. The method according to claim 3, wherein the dynamo is driven by a translatory movement.

5. The method according to claim 3, wherein the dynamo is driven by an oscillating movement.

6. The method according to claim 3, wherein the dynamo is driven by a rotary movement.

7. The method according to claim 1, wherein, in the step of the operator driving the mechanical drive action to generate electric energy by the voltage source, the mechanical drive action simultaneously actuates a fuel pump providing an initial fuel conveyance for starting the internal combustion engine.

8. The method according to claim 1, wherein, in the step of the operator driving the mechanical drive action to generate electric energy by the voltage source, the mechanical drive action actuates a fuel pump providing an initial fuel pressure.

9. The method according to claim 1, further comprising the step of checking proper function of sensors and actuators by the engine control unit before start of the internal combustion engine, wherein at least the energy management of the internal combustion engine is taken into consideration and plausibility of the sensor signals is utilized for determining whether the internal combustion engine is to be started or not.

10. A device for providing electric energy for an engine control unit before start of an internal combustion engine that is to be started by a rope starter, the device comprising:

a voltage source;

an energy storage device electrically conductingly connected to the voltage source;

wherein the energy storage device has an output that is electrically conductingly connected to the engine control unit to supply electric energy to the engine control unit;

wherein the voltage source is coupled to a mechanical drive action adapted to be driven by an operator and the mechanical drive action is driven by the operator to generate electric energy by the voltage source prior to a first rope starter pull being carried out.

11. The device according to claim 10, wherein the voltage source is a piezo element.

12. The device according to claim 10, wherein the energy storage device comprises a capacitor.

13. The device according to claim 10, comprising an ignition circuit that is connected to the output of the energy storage device.

14. The device according to claim 10, comprising a light signal device that indicates a sufficient charge level of the energy storage device before start of the internal combustion engine.

15. The device according to claim 10, comprising a mechanical fuel pump that provides fuel pressure before start of the internal combustion engine, wherein said mechanical drive action is coupled with the mechanical fuel pump so that, when the operator drives said mechanical drive action to actuate the mechanical fuel pump, simultaneously the voltage source is driven and electric energy is generated.

16. A method for providing in a hand-held power tool electric energy for an engine control unit before start of an internal combustion engine of the power tool that is to be started mechanically by a rope starter, the method comprising the steps of providing a voltage source as a voltage supply for the engine control unit, wherein the voltage source provides electric energy for operating the internal combustion engine and wherein the voltage source is driven by a mechanical drive action;

an operator driving the mechanical drive action by a translatory movement to generate electric energy by the voltage source before start of the internal combustion engine;

storing the electric energy generated by the voltage source in a rechargeable energy storage device arranged within the power tool; and supplying the electric energy stored in the energy storage device to the engine control unit upon carrying out the first rope starter pull for starting the internal combustion engine.

17. The device according to claim 10, wherein the voltage source is a manually operated dynamo.

* * * * *